US006969067B1

(12) United States Patent
Borruso

(10) Patent No.: US 6,969,067 B1
(45) Date of Patent: Nov. 29, 2005

(54) METHODS FOR CONDUCTING AND PLAYING A LOTTERY GAME

(76) Inventor: Ronald Borruso, 7210 E. Naranja Ave., Mesa, AZ (US) 85208

( * ) Notice: Subject to any disclaimer, the term of this patent is extended or adjusted under 35 U.S.C. 154(b) by 220 days.

(21) Appl. No.: 10/636,798

(22) Filed: Aug. 7, 2003

(51) Int. Cl.[7] ..... A63F 3/06
(52) U.S. Cl. ..... 273/139
(58) Field of Search ..... 273/138.1, 139, 273/144 A, 144 B, 148 R; 283/904; 463/16, 463/17, 22

(56) References Cited

U.S. PATENT DOCUMENTS

| | | | | | |
|---|---|---|---|---|---|
| 4,871,172 | A | * | 10/1989 | Hwang | 273/138.1 |
| 5,116,049 | A | * | 5/1992 | Sludikoff et al. | 273/139 |
| 5,186,463 | A | | 2/1993 | Marin et al. | |
| 5,232,221 | A | * | 8/1993 | Sludikoff et al. | 273/139 |
| 6,024,641 | A | * | 2/2000 | Sarno | 463/17 |
| 6,086,477 | A | | 7/2000 | Walker et al. | |
| 6,220,961 | B1 | | 4/2001 | Keane et al. | |
| 6,325,716 | B1 | | 12/2001 | Walker et al. | |
| 6,497,408 | B1 | | 12/2002 | Walker et al. | |
| 6,572,106 | B2 | * | 6/2003 | Alexoff | 273/138.1 |
| 6,830,514 | B2 | * | 12/2004 | Meyer et al. | 463/17 |
| 2002/0169019 | A1 | | 11/2002 | Walker et al. | |
| 2003/0047869 | A1 | | 3/2003 | Walker et al. | |

* cited by examiner

*Primary Examiner*—Kurt Fernstrom
(74) *Attorney, Agent, or Firm*—Parsons & Goltry; Michael W. Goltry; Robert A. Parsons

(57) ABSTRACT

Disclosed is a method that includes issuing chances to win each consisting of consecutively drawn player characters, receiving from a drawing a result comprising consecutively drawn result characters, comparing the result to each of the chances to win, assigning a first win to one of the chances to win having a first plurality of player characters matching a corresponding first plurality of the result characters in the same drawn order that is one of consecutive, partially consecutive, and non-consecutive, and assigning a second win to one of the chances to win having a second plurality of player characters matching a corresponding second plurality of the result characters in the same drawn order that is one of consecutive, partially consecutive, and non-consecutive.

24 Claims, No Drawings

METHODS FOR CONDUCTING AND PLAYING A LOTTERY GAME

FIELD OF THE INVENTION

This invention relates to lotteries.

BACKGROUND OF THE INVENTION

Lottery is a procedure for distributing something (usually money or prizes) among a group of people by lot or chance. The type of lottery considered here is a form of gambling in which a usually large number of people purchase chances called lottery tickets, in which the winning tickets are drawn from a pool composed of all tickets sold or offered for sale. The value of the prizes is the amount remaining after expenses, which include the profits for the promoter, the costs of promotion, the portion allocated to designated state purposes, and the taxes and other charges. In most large-scale lotteries, a very large prize is offered along with many smaller ones. Lotteries have a very wide appeal as a means for raising money; they are simple to organize, easy to plan, and, in general, popular but controversial.

The practice of determining the distribution of property by lot is traceable to ancient times. Among dozens of Biblical examples, the Old Testament (Numbers 26:55–56) has the Lord instructing Moses to take a census of the people of Israel and to divide the land among them by lot. The Roman emperors Nero and Augustus used lotteries to give away property and slaves during Saturnalian feasts and other entertainments. Modern lotteries of a similar type include those used for military conscription, commercial promotions in which property is given away by a random procedure, and the selection of jury members from lists of registered voters. Under the strict definition of a gambling type of lottery, however, payment of a consideration (property, work, or money) must be made for a chance of receiving the prize.

The basic elements of modern lotteries are usually quite simple. First, there must be some means of recording the identities of the bettors, the amounts staked by each, and the number or other symbol on which the money is bet. The bettor may write his name on a ticket that is deposited with the lottery organization for subsequent shuffling and possible selection in the drawing. Or the bettor may buy a numbered receipt, in the knowledge that this number will be entered into a pool of numbers, the bettor having the responsibility of determining later if his ticket was among the winners. Another procedure requires only that the bettor inform a representative of the lottery which number he guesses will be drawn, and the representative is trusted to appear later with the prize, if any is won. This is the usual procedure in the illegal numbers game, which has been popular for several decades in many cities throughout the United States.

A second element of all lotteries is the drawing, which is a procedure for determining winning numbers. This may take the form of a pool or collection of tickets or their counterfoils from which the winners are extracted. The tickets must first be thoroughly mixed by some mechanical means, such as shaking or tossing; this is a randomizing procedure designed to insure that chance and only chance determines the selection of winners. Computers have increasingly come into use for this purpose because of their capacity for storing information about large numbers of tickets and also for generating random numbers for identifying the winners. Promoters of public, especially of large-scale, lotteries may exploit the opportunity to make the drawing and/or mixing process as colorful and dramatic as possible.

The third element common to all lotteries is the existence of a mechanism for collecting and pooling all the money placed as stakes. This is usually accomplished by a hierarchy of sales agents who pass money paid for the tickets up through the organization until it is "banked." A practice common in many national lotteries is to divide tickets into fractions, usually tenths. Each fraction if and when it is sold separately costs slightly more than its share of the total cost of an entire ticket. Many people then buy whole tickets, in effect at a premium or discounted price, for marketing in the streets where customers can place relatively small stakes on the fractions. In a large-scale lottery, the use of the regular mail system is desirable for communicating information and transporting tickets and stakes. In the United States and some other countries, however, postal rules prohibit use of the mails. Postal prohibitions apply also to international mailings of lotteries. Though post-office authorities are diligent, it is clear that much smuggling and other violation of interstate and international regulations occurs.

A fourth requirement is a set of rules determining the frequencies and sizes of the prizes. Costs of organizing and promoting the lotteries must be deducted from the pool, and a percentage normally goes as revenues and profits to the state or sponsor. Of the remainder available for the winners, a decision must be made on whether to pay few large prizes or many smaller ones. Potential bettors seem to be attracted to lotteries that offer very large prizes, but in some cultures they also demand a chance to win smaller ones. Authorities on lotteries disagree about which of these choices is better for the welfare of the people and the economic success of the lottery. The amount of the pool returned to the bettors tends to be between 50 percent and 60 percent.

A modern form of lottery ticket sales is the on-line sale, in which tickets are printed by a terminal/printer in a merchant's store. In an online sale where the player chooses numbers, the terminal/printer is connected to a secure central computer system operated by the state lottery commission, and it is that central computer system that recognizes and accepts the players' choices of numbers and sends signals to the remote terminal/printer to print the ticket with selected numbers and records the transaction in a secure central database or databank. In a "quick-pick" type of transaction, which is ubiquitous in modern numbers lotteries, the central computer provides the numbers and sends a signal to the remote terminal/printer to print the ticket with those numbers and then records that transaction in the secure central databank.

In multi-state games such as Powerball®, the procedure is basically the same, with each participating state being responsible for verification and winner files, and then reporting to the central coordinating group. In on-line lottery games, a matrix is established that governs the winning combinations and the prize structure. All on-line tickets bear special secure coding to help minimize fraud. Over the past few years, on-line lottery tickets have become less popular than instant lottery tickets, due mostly to the fact that instant tickets are much more likely to be purchased on impulse than on-line tickets.

In instant lottery sales, participating merchants receive a number of pre-printed tickets, which are furnished with secure coding minimizing fraud. Like on-line sales, the prizes printed on such tickets are also determined by a matrix that governs winning combinations and the prize structure, based on the prize pay-outs desired, the number of retailers participating and the populations they serve. In order to see the numbers or prizes printed on the tickets and determine if they hold a winning ticket, players scratch off the coating that obscures the printing. Although winning combinations have been printed on some of those instant tickets, no one knows where they are in the package, or even which store received packages containing big winner tickets.

There are also other variations of instant games including punch-board, pull-tab and break-opens. Unlike on-line tickets and scratch-off instant tickets, these variations come in pre-set, pre-determined packages where the matrix has already been built in according to some pre-determined formula suitable for smaller establishments. Unlike scratch-off games, these games have an advantage in that it is a simple matter to add an additional retailer because the addition of that retailer will not affect the matrix because it has been pre-determined, based on the number of tickets comprising the package.

In both online and instant ticket lotteries, prizes that remain unclaimed after some statutorily prescribed period that varies from state to state, ranging up to one year, become void as winning tickets. After the winning tickets become void, any prize money can revert to the state, or be added to future prize pools.

Among the family of modern lottery games are the "passive" or "passive draw" game, the "instant" game, the "pick" game, and the "lotto" game. The "passive draw" game includes a purchase of a pre-numbered ticket. Passive draw tickets are generally sold in ascending numerical order and after a certain period of time a winning number is selected and a prize is awarded to the holder of the ticket bearing the winning number. Another version of a passive game is to add various ways to win. Take an example in which the number selected in a passive drawing is 978571. Holders of tickets matching the first two digits of 97 win prizes, tickets matching the first three digits 978 win prizes, and so forth.

In an "instant" game, a player purchases a preprinted ticket with revealable numbers, symbols, or other game characters. Instant games are usually based on a theme such as card games, lucky numbers, familiar characters, etc. Tickets containing three like symbols win a prize, in which the prize level is preset. If a player's card is a winning card, then the player can immediately (instantly) cash the ticket and receive a prize. There is no traditional drawing to determine a winner in an instant game, and there are literally hundreds of variations of instant games.

In an example of a "pick" game, a player selects a 3 digit number from 000–999. A random number from 000–999 is drawn. If the drawn number matches the number selected by a player, then the player wins a prize. This type of pick game is a "straight bet" game. Another example of a pick game involves a player who selects to play just the first two digits or the last two digits of, for instance, a three digit number. In this case, the prize that may be won is lower but the player only has to match the two digits, in exact order, instead of all three digits. These are called "front and back pair" bets. Yet another variation is called a "box" bet, in which a player selects, for instance, a three digit number but is playing every order of the three digits. For instance, if a player plays the number 123 boxed, then the player really has purchased 6 bets, one each on 123 132, 231, 213, 312, and 321. If any one of these numbers is drawn, the player wins.

A "lotto" game is often referred to as a matrix game, in which a player selects X numbers from a pool of Z numbers. The lottery draws Y numbers from the pool of Z numbers. Players win a prize if enough of their selections match the selections drawn by the lottery. As an example, if the lotto game were a 6-6-36, then the player would select 6 numbers from a pool of 36 and the lottery would draw 6 numbers from the pool of 36 numbers. Players would win if their selections match 3, 4, 5, or 6 of the lottery selections. In this type of game, numbers cannot be duplicated. In other words, every number in a lotto style game is unique, and the order is not relevant in a lotto game.

Although the art is replete with various systems and methods for conducting and playing lotteries, needed is yet another that is simple to conduct, uncomplicated, and that provides players with many ways to win.

SUMMARY OF THE INVENTION

The above problems and others are at least partially solved and the above purposes and others realized in a preferred method including issuing chances to win each consisting of consecutively drawn player characters, receiving from a drawing a result comprising consecutively drawn result characters, comparing the result to each of the chances to win, assigning a first win to one of the chances to win having a first plurality of player characters matching a corresponding first plurality of the result characters in the same drawn order that is one of consecutive, partially consecutive, and non-consecutive, and assigning a second win to one of the chances to win having a second plurality of player characters matching a corresponding second plurality of the result characters in the same drawn order that is one of consecutive, partially consecutive, and non-consecutive. The first plurality of player characters is lesser than the second plurality of player characters. The instant method further includes assigning a first prize having a value to the first win, and assigning a second prize having a value to the second win, in which the value of the first prize is lesser than the value of the second prize. The consecutively drawn player characters of each of the chances to win include at least five consecutively drawn player characters, and the consecutively drawn result characters comprise at least five consecutively drawn result characters. In one embodiment, the chances to win are issued to players over a networked computer environment. In another embodiment, the chances to win are issued to players with a lottery ticket dispensing system.

Another preferred method embodiment includes providing a result consisting of consecutively drawn result characters, issuing chances to win each consisting of consecutively drawn player characters, comparing the result to each of the chances to win, assigning a first win to one of the chances to win having a first plurality of player characters matching a corresponding first plurality of the result characters in the same drawn order that is one of consecutive, partially consecutive, and non-consecutive, and assigning a second win to one of the chances to win having a second plurality of player characters matching a corresponding second plurality of the result characters in the same drawn order that is one of consecutive, partially consecutive, and non-consecutive. The first plurality of player characters is lesser than the second plurality of player characters. The instant method further includes assigning a first prize having a value to the first win, and assigning a second prize having a value to the second win, in which the value of the first prize is lesser than the value of the second prize. The consecutively drawn player characters of each of the chances to win include at least five consecutively drawn player characters, and the consecutively drawn result characters comprise at least five consecutively drawn result characters. In one embodiment, the chances to win are issued to players over a networked computer environment. In another embodiment, the chances to win are issued to players with a lottery ticket dispensing system.

Yet another method embodiment includes providing a chance to win consisting of consecutively drawn player characters, receiving from a drawing a result comprising consecutively drawn result characters, comparing the result to the chance to win, and one of a)assigning a first win to the chance to win if the chance to win has a first plurality of player characters matching a corresponding first plurality of the result characters in the same drawn order that is one of consecutive, partially consecutive, and non-consecutive, and b)assigning a second win to the chance to win if the chance to win has a second plurality of player characters matching a corresponding second plurality of the result characters in the same drawn order that is one of consecutive, partially consecutive, and non-consecutive, in which the first plurality of player characters is lesser than the second plurality of player characters. Further to the instant method are steps of assigning a first prize having a value to the first win, and assigning a second prize having a value to the second win, in which the value of the first prize is lesser than the value of the second prize. The consecutively drawn player characters include at least five consecutively drawn player characters, and the consecutively drawn result characters include at least five consecutively drawn result characters. In one embodiment, the chance to win is issued to a player over a networked computer environment. In another embodiment, the chance to win is issued to a player with a lottery ticket dispensing system. In yet a further embodiment, the chance to win is issued to a player over a gaming unit, such as a slot machine.

Yet still another embodiment includes providing a result consisting of consecutively drawn result characters, issuing a chance to win consisting of consecutively drawn player characters, comparing the result to the chance to win, assigning a first win to the chance to win if the chance to win has a first plurality of player characters matching a corresponding first plurality of the result characters in the same drawn order that is one of consecutive, partially consecutive, and non-consecutive, and assigning a second win to the chance to win if the chance to win has a second plurality of player characters matching a corresponding second plurality of the result characters in the same drawn order that is one of consecutive, partially consecutive, and non-consecutive, in which the first plurality of player characters is lesser than the second plurality of player characters. Further to the instant method are steps of assigning a first prize having a value to the first win, and assigning a second prize having a value to the second win, in which the value of the first prize is lesser than the value of the second prize. The consecutively drawn player characters include at least five consecutively drawn player characters, and the consecutively drawn result characters include at least five consecutively drawn result characters. In one embodiment, the chance to win is issued to a player over a networked computer environment. In another embodiment, the chance to win is issued to a player with a lottery ticket dispensing system. In yet a further embodiment, the chance to win is issued to a player over a gaming unit, such as a slot machine.

Consistent with the foregoing summary of preferred embodiments of the invention and the ensuing specification, which are to be taken together, the invention also contemplates associated lottery system and method embodiments.

DETAILED DESCRIPTION OF PREFERRED EMBODIMENTS

Methods of conducting and playing a lottery game are disclosed. In accordance with the principle of the invention, a preferred method includes issuing chances to win to players, in which each chance to win consists of consecutively drawn player characters. As way of drawing player characters in a chance to win, a player can choose or select player characters, if desired, such as from a pool of characters. A pool of characters can be a pool of 10 characters, a pool of 15 characters, a pool of 20 characters, a pool of 40 characters, etc. As way of drawing player characters in a chance to win, a player can be issued player characters selected from a random draw of player characters, if desired, such as from a pool of characters. The player characters, as with the result characters to be later discussed, can be one or more of the following including letters, numbers, objects, symbols, colors, pictures, etc. The chances to win are preferably presented on lottery tickets that are issued to players in any manner in which chances to win are issued to players in a lottery in which there is to be drawing for the purpose of determining a winner or winners. For instance, in one embodiment the chances to win are issued to players over a networked computer environment, such as a local area network, a global computer network, etc. In another embodiment, the chances to win are issued to players with a conventional lottery ticket dispensing system. Players can be required to make a purchase of a consumer item and/or purchase lottery tickets in order to enter into the lottery game of the invention, although the chances to win can be issued to players without the need for the players to purchase them or to make a purchase of a consumer item. Typically, lottery tickets incorporating the chances to win under the invention are to be purchased by players, much like the POWERBALL® lottery and other similar lottery forms.

After a predetermined number of chances to win are issued or after a predetermined period of time in which chances to win are available to be issued to players, a random drawing is conducted, such as in a straight drawing procedure or other form of random drawing procedure, in which there is a step of receiving from the drawing a result including consecutively drawn result characters. The random drawing for the result can, if desired, be conducted before chances to win are issued to players. In accordance with the invention, the number of result characters is equal to the number of player characters, such as four, five, six, seven, etc. As a matter of example in connection with a preferred embodiment, the consecutively drawn player characters of each of the chances to win include at least five consecutively drawn player characters, and the consecutively drawn result characters also include at least five consecutively drawn result characters. Although five result characters and five player characters are disclosed in a preferred embodiment, less or more can be used, whether three, five, six, seven, etc. After the result is obtained from the drawing, the invention includes comparing the result to each of the chances to win (it is envisioned that each player will compare his chance to win with the result), assigning a win to one of the chances to win having a plurality of player characters matching a corresponding plurality of the result characters in the same drawn order that is one of consecutive, partially consecutive, and non-consecutive, and assigning a prize to the win.

An example of a chance to win and a result obtained from a drawing is set forth below in Example A:

Example A

| | Position 1 | Position 2 | Position 3 | Position 4 | Position 5 |
|---|---|---|---|---|---|
| Chance | 7 | 3 | 15 | 12 | 19 |
| Result | 3 | 19 | 15 | 12 | 8 |

In Example A, there is a chance consisting of five consecutively drawn player characters, and there is a result consisting of five consecutively drawn result characters. As can be seen above, positions 3 and 4 of the chance match positions 3 and 4 of the result. Accordingly, the chance is a winner because the chance has a plurality of player characters that matches a corresponding plurality of result characters in the same drawn order. Although the chance has number 19 at position 5 and the result has number 19 at position 2, there is no match with the number 19 because the position for number 19 of the chance falls at a different position than the number 19 of the result. Accordingly, the chance in Example A is a 2 for 5 winner. Because the chance in Example A is a winner, a prize having a value is assigned to the winning chance. Although positions 3 and 4 are consecutive positions, matching characters between a chance and a result need not fall in consecutive order in order for there to be a winning chance under the teachings of the invention, but rather need only fall at the same corresponding positions. The chance in Example A is an example of a consecutive win, in which all two of the two matching numbers fall in consecutive order.

Another example of a chance to win and the result as in Example A is set forth below in Example B:

Example B

| | Position 1 | Position 2 | Position 3 | Position 4 | Position 5 |
|---|---|---|---|---|---|
| Chance | 7 | 3 | 15 | 12 | 19 |
| Result | 7 | 19 | 15 | 12 | 8 |

In Example B, there is a chance consisting of five consecutively drawn player characters, and there is the result as in Example A. As can be seen above, positions 1, 3 and 4 of the chance match positions 1, 3, and 4, of the result. Accordingly, the chance in Example B is a winner because the chance has a plurality of player characters that matches a corresponding plurality of result characters in the same drawn order. Although the chance has number 19 at position 5 and the result has number 19 at position 2, there is no match with the number 19 because the position for number 19 of the chance falls at a different position than the number 19 of the result. Accordingly, the chance in Example B is a 3 for 5 winner, which is 1 character more than the 2 for 5 character in Example A. Because the chance in Example B is a winner, a prize having a value is assigned to the winning chance. Because statistically it is more difficult to attain a 3 for 5 winner than a 2 for 5 winner, the prize assigned to the 3 for 5 winner is, in accordance with the invention, of greater value than the prize assigned to the 2 for 5 winner in Example A. The chance in Example B is an example of a partially consecutive win, in which two of the three matching numbers fall in consecutive order.

Yet another example of a chance to win and the result as in Examples A and B is set forth below in Example C:

Example C

| | Position 1 | Position 2 | Position 3 | Position 4 | Position 5 |
|---|---|---|---|---|---|
| Chance | 7 | 3 | 15 | 19 | 8 |
| Result | 7 | 19 | 15 | 12 | 8 |

In Example C, there is a chance consisting of five consecutively drawn player characters, and there is the result as in Examples A and B. As can be seen above, positions 1, 3 and 5 of the chance match positions 1, 3, and 5, of the result. Accordingly, the chance in Example C is a 3 for 5 winner, and the discussion of the 3 for 5 winner in Example B applies to the 3 for 5 winner in Example C. The chance in Example C is an example of a non-consecutive win, in which none of the matching numbers fall in consecutive order.

Yet still another example of a chance to win and the result as in Examples A, B, and C is set forth below in Example D:

Example D

| | Position 1 | Position 2 | Position 3 | Position 4 | Position 5 |
|---|---|---|---|---|---|
| Chance | 7 | 3 | 15 | 12 | 8 |
| Result | 7 | 19 | 15 | 12 | 8 |

In Example D, there is a chance consisting of five consecutively drawn player characters, and there is the result as in Examples A, B, and C. As can be seen above, positions 1, 3, 4, and 5 of the chance match positions 1, 3, 4, and 5 of the result. Accordingly, the chance in Example D is a winner because the chance has a plurality of player characters that matches a corresponding plurality of result characters in the same drawn order. Accordingly, the chance in Example D is a 4 for 5 winner, which is 2 characters more than the 2 for 5 winner in Example A, and 1 character more than the 3 for 5 winners in Examples B and C. Because the chance in Example D is a winner, a prize having a value is assigned to the winning chance. Because statistically it is more difficult to attain a 4 for 5 winner than a 2 for 5 winner and a 3 for 5 winner, the prize assigned to the 4 for 5 winner is, in accordance with the invention, of greater value than the prize assigned to the 2 to 5 winner in Example A, and the prize assigned to each of the 3 for 5 winners in Examples B and C. The chance in Example D is an example of a partially consecutive win, in which three of the four matching numbers fall in consecutive order.

Yet still another example of a chance to win and the result as in Examples A, B, C, and D is set forth below in Example E:

Example E

| | Position 1 | Position 2 | Position 3 | Position 4 | Position 5 |
|---|---|---|---|---|---|
| Chance | 7 | 19 | 15 | 12 | 8 |
| Result | 7 | 19 | 15 | 12 | 8 |

In Example D, there is a chance consisting of five consecutively drawn player characters, and there is the result as in Examples A, B, C, and D. As can be seen above, all of the positions of the chance, namely, positions 1, 2, 3, 4, and 5, match all of the positions of the result, namely, positions 1, 2, 3, 4, and 5. Accordingly, the chance in Example E is a winner because the chance has a plurality of player characters that matches a corresponding plurality of result characters in the same drawn order. Accordingly, the chance in Example E is a 5 for 5 winner, which is 3 characters more than the 2 for 5 winner in Example A, 2 characters more than the 3 for 5 winners in Examples B and C, and 1 character more than the 4 for 5 winner in Example D. Because the chance in Example E is a winner, a prize having a value is assigned to the winning chance. Because statistically it is more difficult to attain a 5 for 5 winner than a 2 for 5 winner, a 3 for 5 winner, and also a 4 for 5 winner, the prize assigned to the 5 for 5 winner is, in accordance with the invention, of greater value than the prize assigned to the 2 to 5 winner in Example A, the prize assigned to each of the 3 for 5 winners in Examples B and C, and the prize assigned to the 4 for 5 winners in Example D. The chance in Example E is an example of a consecutive win, in which all five of the five matching numbers fall in consecutive order.

A further example of a chance to win and a result obtained from a drawing is set forth below in Example F:

Example F

| | Position 1 | Position 2 | Position 3 | Position 4 | Position 5 |
|---|---|---|---|---|---|
| Chance | 7 | 3 | 15 | 11 | 19 |
| Result | 3 | 19 | 15 | 12 | 8 |

In Example F, there is a chance consisting of five consecutively drawn player characters, and there is a result as in Examples A, B, C, D, and E. As can be seen above, position 3 of the chance match position 3 of the result. Accordingly, the chance is a winner because the chance has one player character that matches a corresponding result character in the same drawn order. Although the chance has number 19 at position 5 and the result has number 19 at position 2, there is no match with the number 19 because the position for number 19 of the chance falls at a different position than the number 19 of the result. Accordingly, the chance in Example F is a 1 for 5 winner. Because the chance in Example F is a winner, a prize having a value is assigned to the winning chance. Because statistically it is easier to attain a 1 for 5 winner than a 2 for 5 winner, the prize assigned to the 1 for 5 winner is, in accordance with the invention, of lesser value than the prize assigned to the 2 for 5 winner in Example A. The chance in Example F is, as defined herein, an example of a non-consecutive win because there is only one matching number.

In each lottery conducted in accordance with the invention, it is to be understood that there could be no winner, one 1 for 5 winner, one 2 for 5 winner, one 3 for 5 winner, one 4 for 5 winner, one 5 for 5 winner, any combination of 1 for 5 to 5 for 5 winners, multiple 1 for 5 winners, multiple 2 for 5 winners, multiple 3 for 5 winners, multiple 4 for 5 winners, multiple 5 for 5 winners, etc. Prizes are preferably monetary prizes, but they can be durable goods such as cars, boats, recreational vehicles, and the like, consumer goods, real property, etc.

In accordance with the foregoing, the invention contemplates various method embodiments including, for instance, a method that includes issuing chances to win each consisting of consecutively drawn player characters, receiving from a drawing a result comprising consecutively drawn result characters, comparing the result to each of the chances to win, assigning a first win to one of the chances to win having a first plurality of player characters matching a corresponding first plurality of the result characters in the same drawn order that is one of consecutive, partially consecutive, and non-consecutive, and assigning a second win to one of the chances to win having a second plurality of player characters matching a corresponding second plurality of the result characters in the same drawn order that is one of consecutive, partially consecutive, and non-consecutive. The first plurality of player characters is lesser than the second plurality of player characters. The instant method further includes assigning a first prize having a value to the first win, and assigning a second prize having a value to the second win, in which the value of the first prize is lesser than the value of the second prize. The consecutively drawn player characters of each of the chances to win include at least five consecutively drawn player characters, and the consecutively drawn result characters comprise at least five consecutively drawn result characters. In one embodiment, the chances to win are issued to players over a networked computer environment. In another embodiment, the chances to win are issued to players with a lottery ticket dispensing system.

Another method embodiment under the teachings of the invention includes providing a result consisting of consecutively drawn result characters, issuing chances to win each consisting of consecutively drawn player characters, comparing the result to each of the chances to win, assigning a first win to one of the chances to win having a first plurality of player characters matching a corresponding first plurality of the result characters in the same drawn order that is one of consecutive, partially consecutive, and non-consecutive, and assigning a second win to one of the chances to win having a second plurality of player characters matching a corresponding second plurality of the result characters in the same drawn order that is one of consecutive, partially consecutive, and non-consecutive. The first plurality of player characters is lesser than the second plurality of player characters. The instant method further includes assigning a first prize having a value to the first win, and assigning a second prize having a value to the second win, in which the value of the first prize is lesser than the value of the second prize. The consecutively drawn player characters of each of the chances to win include at least five consecutively drawn player characters, and the consecutively drawn result characters comprise at least five consecutively drawn result characters. In one embodiment, the chances to win are issued to players over a networked computer environment. In another embodiment, the chances to win are issued to players with a lottery ticket dispensing system.

The invention can be carried out in connection with one player and, more over, one chance to win, if desired. In this embodiment, there is provided a method embodiment under the teachings of the invention that includes providing a chance to win consisting of consecutively drawn player characters, receiving from a drawing a result comprising consecutively drawn result characters, comparing the result to the chance to win, and one of a)assigning a first win to the chance to win if the chance to win has a first plurality of player characters matching a corresponding first plurality of the result characters in the same drawn order that is one of consecutive, partially consecutive, and non-consecutive, and b)assigning a second win to the chance to win if the chance to win has a second plurality of player characters matching a corresponding second plurality of the result characters in the same drawn order that is one of consecutive, partially consecutive, and non-consecutive, in which the first plurality of player characters is lesser than the second plurality of player characters. Further to the instant method are steps of assigning a first prize having a value to the first win, and assigning a second prize having a value to the second win, in which the value of the first prize is lesser than the value of the second prize. The consecutively drawn player characters include at least five consecutively drawn player characters, and the consecutively drawn result characters include at least five consecutively drawn result characters. In one embodiment, the chance to win is issued to a player over a networked computer environment. In another embodiment, the chance to win is issued to a player with a lottery ticket dispensing system. In yet a further embodiment, the chance to win is issued to a player over a gaming unit or individual gaming unit, which also pays prizes to winning chances. An example of a gaming unit or individual gaming unit is machine such as a slot machine or a video lottery terminal, in which the drawing for the result consists of the player activating the machine in a game of play so as to cause the machine to produce the result, or cause the machine to provide or receive a result from a centralized or remote gaming control system. In a machine scenario, prizes are paid out to winning chances in accordance with normal machine practice. The chance to win from a gaming unit, such as a slot machine or a video lottery terminal, can be issued by the gaming unit, or from another source, or input into the gaming unit, whether by a player or by some other person. Other forms of gaming units can be adapted and arranged to carry out the invention in accordance with the teachings thereof, if desired.

The invention also contemplates yet another method including providing a result consisting of consecutively drawn result characters, issuing a chance to win consisting of consecutively drawn player characters, comparing the result to the chance to win, assigning a first win to the chance to win if the chance to win has a first plurality of player characters matching a corresponding first plurality of the result characters in the same drawn order that is one of consecutive, partially consecutive, and non-consecutive, and assigning a second win to the chance to win if the chance to win has a second plurality of player characters matching a corresponding second plurality of the result characters in the same drawn order that is one of consecutive, partially consecutive, and non-consecutive, in which the first plurality of player characters is lesser than the second plurality of player characters. Further to the instant method are steps of assigning a first prize having a value to the first win, and assigning a second prize having a value to the second win, in which the value of the first prize is lesser than the value of the second prize. The consecutively drawn player characters include at least five consecutively drawn player characters, and the consecutively drawn result characters include at least five consecutively drawn result characters. In one embodiment, the chance to win is issued to a player over a networked computer environment. In another embodiment, the chance to win is issued to a player with a lottery ticket dispensing system. In yet a further embodiment, the chance to win is issued to a player over a gaming unit as previously described.

In sum, new and improved methods for conducting and playing a lottery game are disclosed, in which chances to win are issued to players. The chances to win each have a predetermined number of consecutively drawn characters and are compared to a result having the same number of consecutively drawn characters as each of the chances to win. Preferably, player and result characters are taken from the same pool of characters, and the pool can have 10 characters, 15 characters, 20 characters, 40 characters, etc. Duplication of characters in each chance to win, and in the result, can be prohibited, if desired. In another embodiment, duplication of characters in each chance to win, and in the result, can be permitted, if desired. A winning chance has as least one player character that matches a corresponding one of the result characters of the result. Each matching pair of player and result characters need match and fall at the same position or order. Matching player and result characters need not be consecutive, but can be non-consecutive, partially consecutive, or consecutive. The invention can be carried out with a single player and a corresponding single chance to win, or a plurality of players and a corresponding plurality of chances to win. The result is usually drawn after issuance of the chance to win or the chances to win, although the result can be obtained before issuance of the chance to win or the chances to win. In accordance with the invention, the more matching player and result characters the more valuable the assigned prize.

The present invention is described above with reference to preferred embodiments. Those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described preferred embodiments of the invention in such clear and concise terms as to enable those skilled in the art to understand and practice the same, the invention claimed is:

1. A method comprising steps of:

issuing chances to win each consisting of consecutively drawn player characters;

receiving from a drawing a result comprising consecutively drawn result characters;

comparing the result to each of the chances to win;

assigning a first win to one of the chances to win having a first plurality of player characters matching a corresponding first plurality of the result characters in the same drawn order that is one of consecutive, partially consecutive, and non-consecutive; and assigning a second win to one of the chances to win having a second plurality of player characters matching a corresponding second plurality of the result characters in the same drawn order that is one of consecutive, partially consecutive, and non-consecutive.

2. The method of claim 1, wherein the first plurality of player characters is lesser than the second plurality of player characters.

3. The method of claim 2, further comprising:

assigning a first prize having a value to the first win; and assigning a second prize having a value to the second win;

wherein the value of the first prize is lesser than the value of the second prize.

4. The method of claim 1, wherein:

the consecutively drawn player characters of each of the chances to win comprise at least five consecutively drawn player characters; and the consecutively drawn result characters comprise at least five consecutively drawn result characters.

5. The method of claim 1, wherein the chances to win are issued to players over a networked computer environment.

6. The method of claim 1, wherein the chances to win are issued to players with a lottery ticket dispensing system.

7. A method comprising steps of:

providing a result comprising consecutively drawn result characters;

issuing chances to win each consisting of consecutively drawn player characters;

comparing the result to each of the chances to win;

assigning a first win to one of the chances to win having a first plurality of player characters matching a corresponding first plurality of the result characters in the same drawn order that is one of consecutive, partially consecutive, and non-consecutive; and assigning a second win to one of the chances to win having a second plurality of player characters matching a corresponding second plurality of the result characters in the same drawn order that is one of consecutive, partially consecutive, and non-consecutive.

8. The method of claim 7, wherein the first plurality of player characters is lesser than the second plurality of player characters.

9. The method of claim 8, further comprising:

assigning a first prize having a value to the first win; and assigning a second prize having a value to the second win;

wherein the value of the first prize is lesser than the value of the second prize.

10. The method of claim 7, wherein:

the consecutively drawn player characters of each of the chances to win comprise at least five consecutively drawn player characters; and the consecutively drawn result characters comprise at least five consecutively drawn result characters.

11. The method of claim 7, wherein the chances to win are issued to players over a networked computer environment.

12. The method of claim 7, wherein the chances to win are issued to players with a lottery ticket dispensing system.

13. A method comprising steps of:

providing a chance to win consisting of consecutively drawn player characters;

receiving from a drawing a result comprising consecutively drawn result characters;

comparing the result to the chance to win; and one of:

assigning a first win to the chance to win if the chance to win has a first plurality of player characters matching a corresponding first plurality of the result characters in the same drawn order that is one of consecutive, partially consecutive, and non-consecutive, and assigning a second win to the chance to win if the chance to win has a second plurality of player characters matching a corresponding second plurality of the result characters in the same drawn order that is one of consecutive, partially consecutive, and non-consecutive;

wherein the first plurality of player characters is lesser than the second plurality of player characters.

14. The method of claim 13, further comprising:

assigning a first prize having a value to the first win; and assigning a second prize having a value to the second win;

wherein the value of the first prize is lesser than the value of the second prize.

15. The method of claim 13, wherein:

the consecutively drawn player characters comprise at least five consecutively drawn player characters; and the consecutively drawn result characters comprise at least five consecutively drawn result characters.

16. The method of claim 13, wherein the chance to win is issued to a player over a networked computer environment.

17. The method of claim 13, wherein the chance to win is issued to a player with a lottery ticket dispensing system.

18. The method of claim 13, wherein the chance to win is issued to a player over a gaming unit.

19. A method comprising steps of:

providing a result comprising consecutively drawn result characters;

issuing a chance to win consisting of consecutively drawn player characters;

comparing the result to the chance to win;

assigning a first win to the chance to win if the chance to win has a first plurality of player characters matching a corresponding first plurality of the result characters in the same drawn order that is one of consecutive, partially consecutive, and non-consecutive, and assigning a second win to the chance to win if the chance to win has a second plurality of player characters matching a corresponding second plurality of the result characters in the same drawn order that is one of consecutive, partially consecutive, and non-consecutive;

wherein the first plurality of player characters is lesser than the second plurality of player characters.

20. The method of claim 19, further comprising:

assigning a first prize having a value to the first win; and assigning a second prize having a value to the second win;

wherein the value of the first prize is lesser than the value of the second prize.

21. The method of claim 19, wherein:

the consecutively drawn player characters comprise at least five consecutively drawn player characters; and the consecutively drawn result characters comprise at least five consecutively drawn result characters.

22. The method of claim 19, wherein the chance to win is issued to a player over a networked computer environment.

23. The method of claim 19, wherein the chance to win is issued to a player with a lottery ticket dispensing system.

24. The method of claim 19, wherein the chance to win is issued to a player over a gaming unit.

* * * * *